US006663413B2

(12) United States Patent
Kuhnel

(10) Patent No.: US 6,663,413 B2
(45) Date of Patent: Dec. 16, 2003

(54) CONNECTOR, PARTICULARLY FOR AIRBAG IGNITION SYSTEMS

(75) Inventor: Bernhard Kuhnel, Altdorf (DE)

(73) Assignee: Framatome Connectors International, Courbevoie (FR)

( * ) Notice: Subject to any disclaimer, the term of this patent is extended or adjusted under 35 U.S.C. 154(b) by 0 days.

(21) Appl. No.: 09/860,746

(22) Filed: May 18, 2001

(65) Prior Publication Data

US 2001/0055921 A1 Dec. 27, 2001

(30) Foreign Application Priority Data

May 22, 2000 (DE) ..... 100 25 296

(51) Int. Cl.[7] ..... H01R 11/20
(52) U.S. Cl. ..... 439/422; 439/460
(58) Field of Search ..... 439/421–424, 439/466–468, 881, 879, 399, 407, 417, 425, 869–873, 457, 459, 460

(56) References Cited

U.S. PATENT DOCUMENTS

| | | | | |
|---|---|---|---|---|
| 3,761,869 A | * | 9/1973 | Hardesty et al. | 439/418 |
| 3,960,430 A | | 6/1976 | Bunnell et al. | 339/97 C |
| 4,516,822 A | * | 5/1985 | Wolfel | 439/459 |
| 4,564,253 A | | 1/1986 | Sinclair | 339/97 C |
| 4,921,440 A | * | 5/1990 | Matsumoto | 439/421 |
| 4,950,180 A | * | 8/1990 | Daly et al. | 439/422 |
| 5,041,007 A | | 8/1991 | Liu et al. | 439/404 |

FOREIGN PATENT DOCUMENTS

| | | |
|---|---|---|
| DE | 4217205 A1 | 12/1993 |
| DE | 4413756 C1 | 7/1995 |
| DE | 19748505 A1 | 5/1998 |
| DE | 19804599 A1 | 8/1999 |
| EP | EP 0 698 947 | 2/1996 |
| EP | 0734100 A2 | 9/1996 |

OTHER PUBLICATIONS

U.S. patent application No. 10/054,570 filed Jan. 22, 2002, "Plug Connector With Strain Relief Clamp".

* cited by examiner

*Primary Examiner*—Renee Luebke
*Assistant Examiner*—Felix O. Figueroa
(74) *Attorney, Agent, or Firm*—Perman & Green, LLP

(57) ABSTRACT

Described is a connector for a cable particularly adapted for airbag ignitions systems, comprising a casing part (1) with a holder (4) for a flat conductor strip (10) and means for contacting the casing part with contact ends (7), the contacting means being in the from of metal strips (6), having crimp plates (9) formed on their first end portions near the cable, and connected at their second end portions to one of the contact ends (7), the crimp plates including both an upper surface and underside regions, the upper surface of the crimp plates (9) including crimp profiles, and the underside regions of the crimp plates (9) positioned below the crimp profiles being suspended over an opening (14) included in the casing.

4 Claims, 3 Drawing Sheets

CONNECTOR, PARTICULARLY FOR AIRBAG IGNITION SYSTEMS

BACKGROUND OF THE INVENTION

1. Field of the Invention

The invention relates to a connector, particularly a connector that is used with airbag ignition systems, the connector including a casing with a holder for a flat conductor strip and means for contacting the holder with contact ends.

2. Description of Prior Developments

Connectors designed for use in airbag ignition systems must be compact and in particular must be flat, since there is very little space for inserting them in a vehicle steering wheel. The connectors must also provide space for filters for preventing electromagnetic interference from accidentally triggering the ignition system. The connectors must also be easy to wire, so that installation of an airbag retaining system is as simple as possible. In known connectors for airbag systems, the connector casing consists of two shells, the lower shell containing the plug contact, the filter and the pins for connecting the lead cable, and the ends of the lead cable are soldered to the connecting pins. The soldering process is complicated and fault-prone.

DE 42 17 205 A1 discloses a connector for airbag applications, the connector being wired with a flat conductor strip and wherein contact pins extend through the individual conductors and electric contact is made by application of solder. In this case also the use of solder is not avoided, and complicated work on the half-finished connector is the result.

SUMMARY OF THE INVENTION

The object of the invention is to disclose a connector, particularly for airbag ignition systems, which can be supplied in a pre-assembly position and is easy to connect to a cable.

According to the features of the present invention these issues are resolved by a connector for a cable particularly adapted for airbag ignition systems that include a casing part with a holder for a flat conductor strip and means for contacting the casing part with contact ends wherein the contacting means are metal strips having crimp plates formed on their first end portions near the cable, and the metal strips being connected at their second end portions to one of the contact ends, the crimp plates including both an upper surface and underside regions, the upper surface of the crimp plates crimp profiles and the underside regions of the crimp plates positioned below the crimp profiles being suspended over an opening included in the casing.

The invention concerns a connector particularly for airbag ignition systems, comprising a casing part (1) with a holder (4) for a flat conductor strip (10) and means for contacting it with contact ends (7), where the contacting means are metal strips (6) with crimp plates (9) formed on their first ends near the cable and connected at their second ends to a contact end (7), the upper surface of the crimp plates (9) having crimp profiles and the underside regions of the crimp plates (9) below the crimp profiles being suspended over an opening (14) provided in the casing. Particularly as described in FIG. 1 the metal strips (6) may have bent lugs (11) at the level of the crimp profiles for insertion into the rear part of the bottom part (1) of the casing.

In a particular embodiment a rear upper part (3) of the casing is provided and is movable between a position in which the crimp profiles are accessible and a position in which they are covered. In such a case the casing (1) via slide grooves (13) and is movable between a pre-assembly position in which a space for inserting a crimping tool is left above the crimping region (9), and a final assembly position in which the rear upper part (3) of the casing covers the crimping region. Additionally, the rear upper part (3) of the casing co-operate with the crimp plate (9) to relieve tension on the cable.

As seen in FIG. 2 the slide grooves (13), viewed in the direction for fitting the rear upper part (3) of the casing, extend downwards in order to increase the pressure of the rear upper part (3) of the casing on the flat conductor strip in the crimping region. In another preferred embodiment the casing (1) is open at the top and a cover (2) covers the connector.

BRIEF DESCRIPTION OF THE DRAWINGS

The invention will now be explained in further detail by describing an exemplified embodiment with reference to the drawings, in which.

DESCRIPTION OF THE PREFERRED EMBODIMENTS

Figure 1:
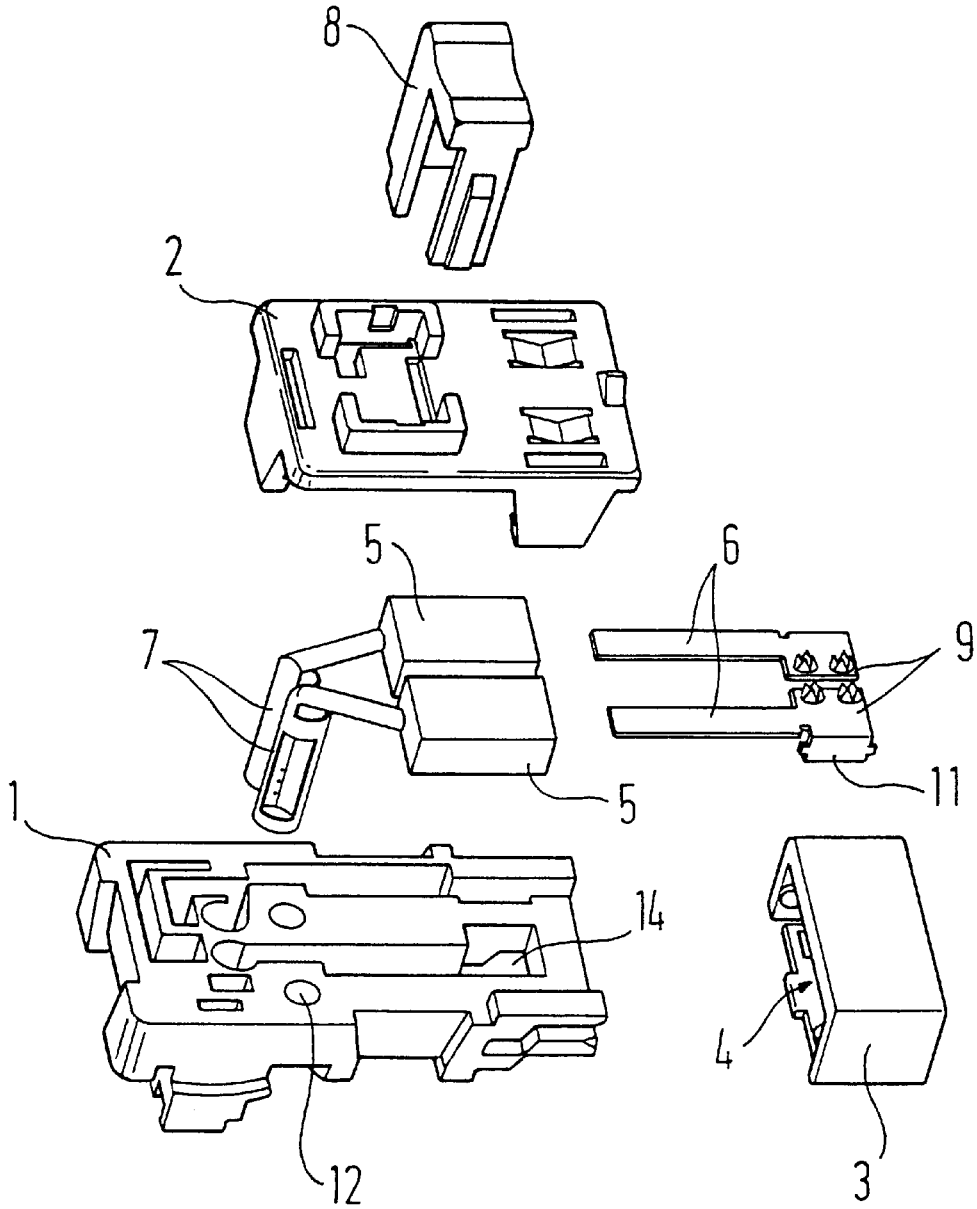
FIG. 1 is an exploded view of a connector according to the invention.

FIG. 1 shows the individual components of the connector according to the invention. The drawing shows the casing components, i.e. a bottom part 1, a cover 2 and a rear upper part 3. The rear upper part 3 has a holder 4 in the form of a slot for a flat conductor strip (not shown), the end of which is inserted through the slot into the casing. Two metal strips 6 are provided for electrically connecting the flat conductor strip 10 to the metal strips, on which a ferrite choke is mounted in the example shown here. A choke at this place is optional and should not be regarded as limitative. The front ends of the metal strips 6 project out of the ferrite blocks 5 and are conductively connected to tongues on plug contacts 7. The bottom part of the casing is profiled on the inside so that the crimp plates 9 of the individual components (plug contacts 7, ferrite blocks 5 and metal strips 6) are mounted firmly in position. Passage openings 12 are provided, e.g. for inserting a spot-welding head to the place for connecting the front ends of the metal strips 6 to the tongues on the contacts 7, in order to electrically connect the half-assembled connector. The cover 2 is then placed and locked on the bottom part 1 of the casing and the secondary locking means 8 are brought into a pre-engagement position.

Figure 2:
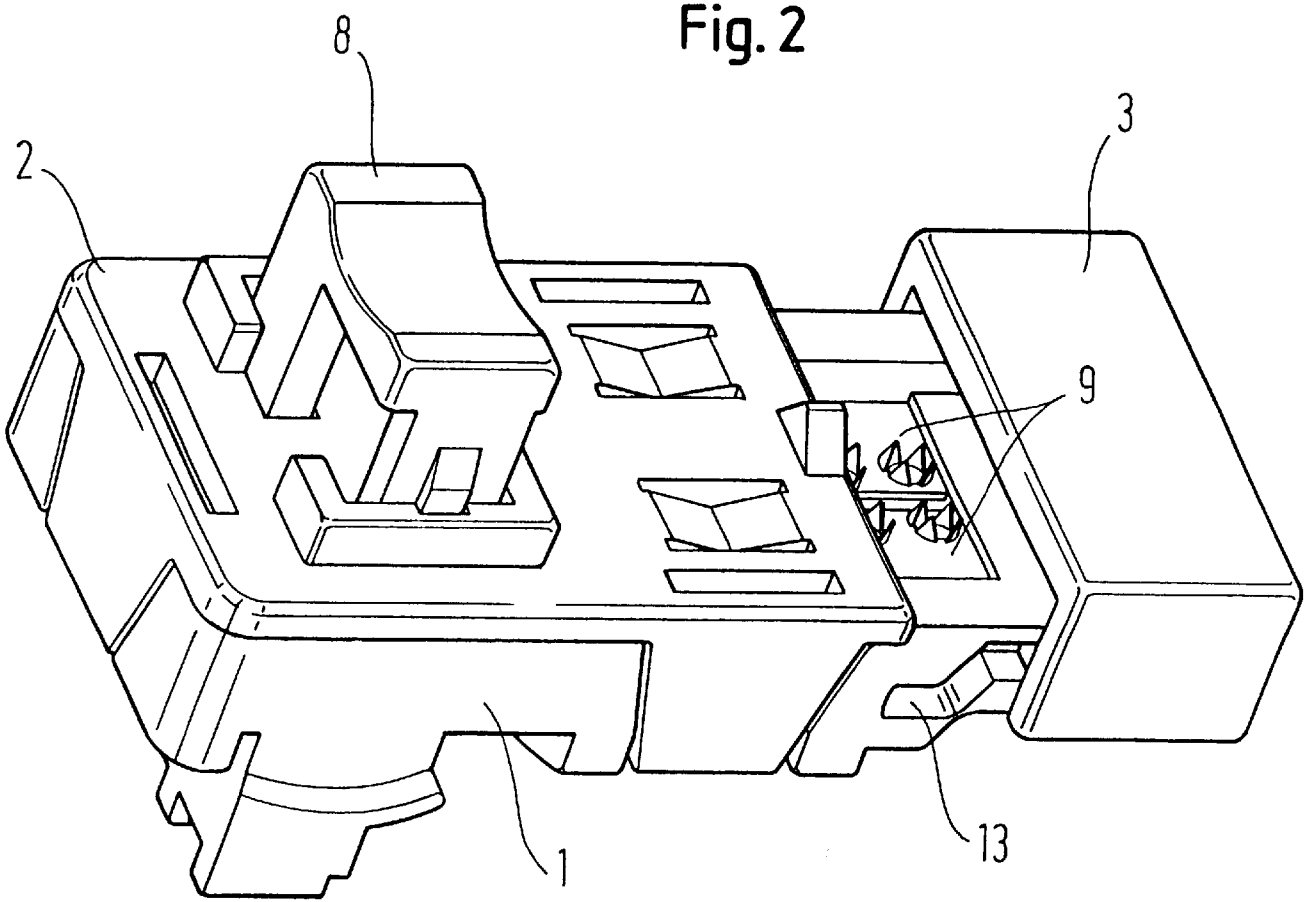
FIG. 2 shows a connector according to the invention in the pre-assembly position and FIG. 3 shows a connector according to the invention with a connected flat conductor strip and engaged secondary locking means.
Figure 3:
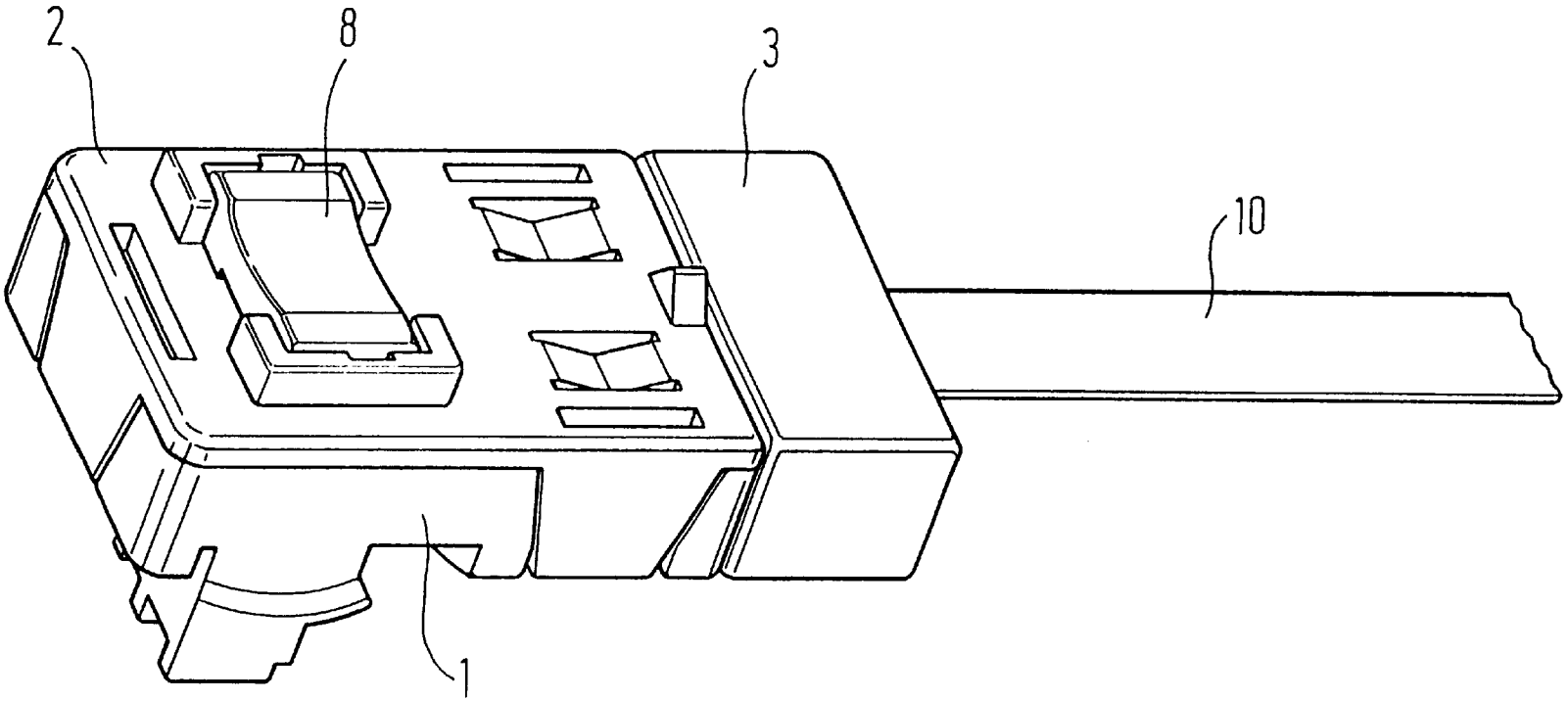

FIG. 2 shows the connector according to the invention in the pre-assembled position, wherein the rear upper part 3 of the casing is already attached by a sliding block and groove locking means 13 so that the crimp plates 9 are accessible to a crimping tool from above and through an opening 14 in the casing 1, for fastening the flat conductor strip 10 to the metal strips 6. When the flat conductor strip 10 is crimped on the metal strips 6, the rear upper part 3 of the casing is moved along the groove 13 into its final position. As FIG. 2 shows, the slide groove, viewed in the closure direction, slopes downwards and has a means for locking in the end position, so that the rear upper casing part is pressed on to the flat conductor strip 10 and thus relieves it from tension.

For final assembly, the connector according to the invention is delivered in the pre-assembly position shown in FIG. 2 and is connected to the flat conductor strip without any soldering and without opening the rest of the casing, so that final assembly is simpler and more reliable.

The preceding description of an exemplified embodiment of the invention is only for illustrating the invention disclosed in the claims and should in no way be regarded as limitative.

What is claimed is:

1. A flex circuit connector for a cable particularly adapted for airbag ignition systems, comprising a casing part with a holder for a flat conductor strip, and means for contacting the casing part with contact ends, wherein the contacting means are metal strips, having crimp plates formed on metal strips first end portions near the cable, and the metal strips being connected at metal strips second end portions to one of the contact ends the crimp plates including both an upper surface and underside region, the upper surface of the crimp plates including crimp profiles, and the underside regions of the crimp plates positioned below the crimp profiles being suspended over an opening included in the casing wherein metal strips include downwardly protruding bent lugs, the lugs being anchored in grooves positioned in a rear part of a bottom part of the casing thereby holding the crimp profiles and providing an improved mechanical holding of the plates, further wherein a rear upper part of the casing is provided and fastened to the casing by slide grooves which when viewed in a direction for fitting the rear upper part of the casing extend downwards, and while fastened is movable between a pre-assembly position in which the crimp profiles are accessible and a space for inserting a crimping tool is left above a crimping plate region, and a final assembly position in which the crimp profiles and the crimping plate region are covered.

2. A connector according to claim 1, wherein said rear upper part of said casing co-operates with said crimp plate to relieve tension on said cable.

3. A connector according to claim 1, wherein said slide grooves extend downwards to thereby increase pressure of said rear upper part of said casing on said flat conductor strip in said crimping plate region.

4. A connector according to claim 1, wherein said casing is open at a top portion and a cover covers said connector.

* * * * *